United States Patent [19]

Levatter et al.

[11] 3,983,438

[45] Sept. 28, 1976

[54] SPARK GAP SWITCH

[75] Inventors: Jeffrey I. Levatter, Palo Alto; Shao-Chi Lin, La Jolla; Paul B. Scott, Topanga, all of Calif.

[73] Assignee: Xonics, Inc., Van Nuys, Calif.

[22] Filed: Aug. 21, 1975

[21] Appl. No.: 606,519

[52] U.S. Cl. ..... 313/146; 313/216; 313/217; 313/325

[51] Int. Cl.[2] ..... H01T 3/00

[58] Field of Search ..... 313/146, 216, 217, 325

[56] References Cited

UNITED STATES PATENTS

| | | | |
|---|---|---|---|
| 2,817,036 | 12/1957 | Neal | 313/146 |
| 2,909,695 | 10/1959 | Melhart | 313/197 |
| 3,030,547 | 4/1962 | Dike et al. | 315/168 |
| 3,543,075 | 11/1970 | Dubois | 313/197 |
| 3,579,027 | 5/1971 | Pater | 313/198 X |
| 3,719,852 | 3/1973 | Goody | 313/178 |

*Primary Examiner*—R. V. Rolinec
*Assistant Examiner*—Darwin R. Hostetter
*Attorney, Agent, or Firm*—Harris, Kern, Wallen & Tinsley

[57] ABSTRACT

A spark gap switch having a central electrode positioned within an annular electrode in a dielectric liquid or saturated vapor flow line, with coaxial or parallel plate electrical connections to said electrodes.

16 Claims, 6 Drawing Figures

SPARK GAP SWITCH

BACKGROUND OF THE INVENTION

This invention relates to spark gap switches for electrical circuits. Switching energy from capacitative or inductive circuits into a load circuit entails problems resulting from the sudden release of energy at the switch. Metallic contact switches tend to burn, to be eroded, or to weld together due to the high temperature produced by the high current.

One solution is to never allow the two conductors to come close to one another, and to let a spark conduct the current. Spark gap switches are commonly used to dump stored energy of a Joule or larger at voltages of tens of kilovolts. Gas, either at atmospheric or superatmospheric pressure, is used as a dielectric. By one of several special techniques, the spark gap switch can be initiated with jitter and turn on time of as low as ten nanoseconds. Several prior art spark gap devices are shown in U.S. Pat. Nos. 2,817,036; 2,909,695; 3,030,547; and 3,543,075.

For many purposes a nanosecond switch operation is desired, which requires very low inductance which in turn requires small size. As the gap must hold off the voltage, the small size dictates high dielectric strength. This may be obtained by raising the gap gas pressure and by using a liquid as the dielectric. In the present invention, a dielectric liquid or saturated vapor is preferred.

It is an object of the invention to provide a new and improved spark gap switch which switch can be small and compact and have turn on times in the order of a few nanoseconds. A further object is to provide such a switch which can utilize a continuous flow of the dielectric through the gap between the electrodes. An additional object of the invention is to provide such a switch wherein a central and an annular electrode are positioned in the dielectric flow path. A specific object is to provide such a switch which can utilize coaxial and parallel plate transmission lines for electrical connections to the electrodes.

Other objects, advantages, features and results will more fully appear in the course of the following description.

SUMMARY OF THE INVENTION

In its preferred embodiment, the spark gap switch of the invention includes a first electrical conducting frame with a first central electrode and a first fluid line mounted therein and a second electrical conducting frame with a second annular electrode and a second fluid line mounted therein. The frames are mounted with an electrical insulator therebetween with the central electrode positioned within the annular electrode and providing for fluid flow through the lines about the central electrode through the annular electrode. A coaxial transmission line provides for electrical connections to the electrodes and a pump or similar device provides a dielectric fluid for continuous flow through the switch.

DESCRIPTION OF THE PREFERRED EMBODIMENTS

Figure 1:
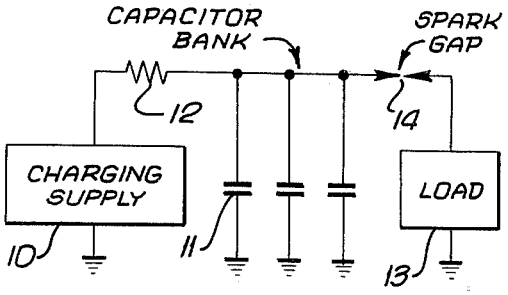
FIG. 1 is an electrical diagram of a typical circuit utilizing a spark gap switch.

In FIG. 1, an electrical charging supply 10 is connected to a plurality of capacitors 11 through a current limiting resistor 12 for charging the capacitors. The bank of capacitors is connected to a load 13 through a spark gap switch 14. When the voltage on the bank of capacitors builds up to a certain value, there is a spark between the electrodes in the switch and the capacitors are discharged through the switch into the load.

A preferred configuration for the spark gap switch 14, utilizing a parallel plate transmission line for feeding the electrodes is shown in FIGS. 2–5. An input line 20 is mounted in a frame 21, preferably by interengaging threads at 22. An O-ring 23 may be positioned in a groove in the line 20 to provide a fluid seal with the frame 21. An electrode 24 is mounted in the line 20, typically on support plates 25 in a cruciform pattern. The cruciform can either be straight for ease of construction, or be twisted into a helical pattern so as to induce a vortical motion in the ensuing flow for better circumferential averaging of the annular electrode heat load. The internal diameter of the line 20 preferably increases from a smaller value at section 28 to a larger value at section 29 containing the electrode 24 so that the cross section area of the flow passage at section 29 is substantially the same as or larger than that at the section 28.

Another fluid line 35 and an annular electrode 36 are mounted in another frame 37. An electrical insulator 40 is positioned between the frames 21, 37, with O-rings 41, 42, 43 for fluid seals. A tapered flow passage 45 in the insulator 40 provides a transition from the line 20 to the electrode 36. The frames and insulator are assembled so that the electrode 24 is positioned within the electrode 36. The inner end of the electrode 24 preferably is tapered as shown, providing for variation of the gap between the electrodes by moving the electrode 24 axially with respect to the electrode 36. This preferably is accomplished by rotating the line 20 relative to the frame 21 with the pitch of the threaded connection at 22 providing for the axial movement of the electrode 24.

A cooler and condenser unit 46, typically a packed column, may be positioned in the line 35 for condensing a vapor dielectric into a liquid to reduce the pumping power requirement.

Figure 6:
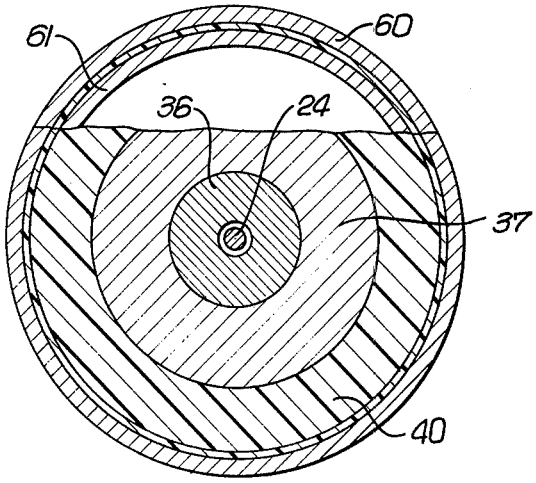
FIG. 6 is a view similar to that of FIG. 5 showing a coaxial transmission line.

Upper and lower outer electrical conductors 50, 51 are connected to the frame 21, and upper and lower inner electrical conductors 52, 53 are connected to the frame 37. An electrical insulator 54 is provided between the conductors 50, 52 and a similar insulator 55 is provided between the conductors 51, 53, and the conductors are clamped together in a conventional manner indicated generally at 57 to provide a parallel plate transmission line. In an alternative configuration shown in FIG. 6, an outer tubular conductor 60 is connected to the frame 21 and an inner tubular conductor 61 is connected to the frame 37 to provide a coaxial transmission line.

Figure 2:
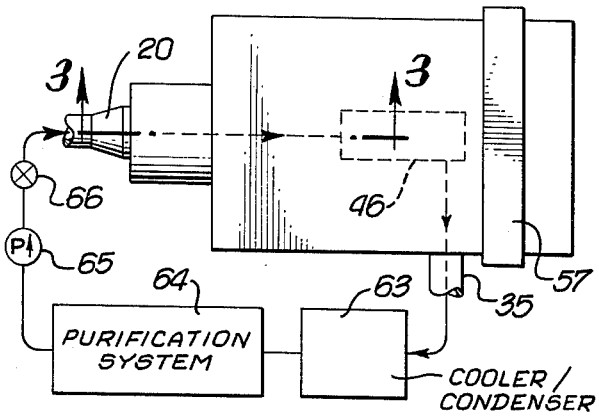
FIG. 2 is a plan view of a spark gap switch with parallel plate transmission line and incorporating the presently preferred embodiment of the invention.
Figure 3:
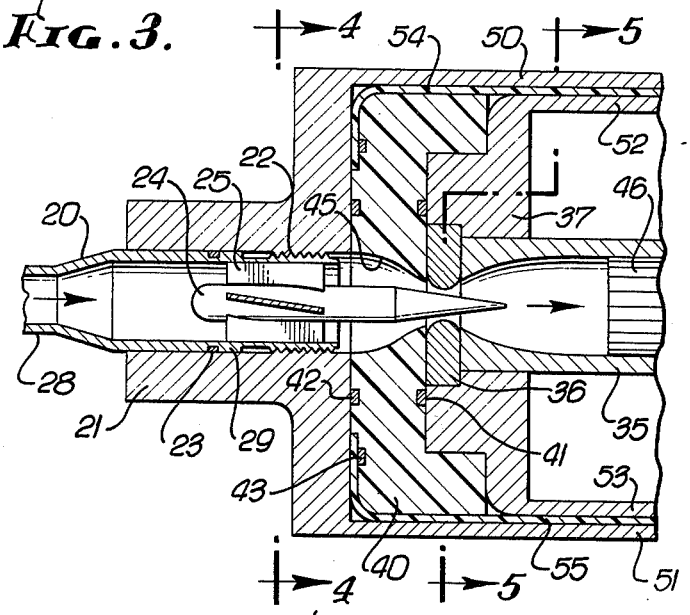
FIG. 3 is an enlarged sectional view taken along the line 3—3 of FIG. 2.
Figure 4:
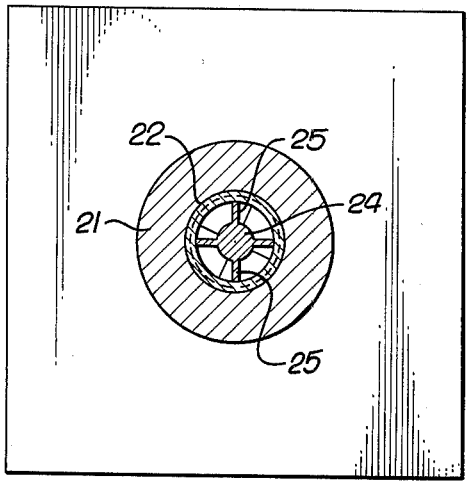
FIG. 4 is a reduced sectional view taken along the line 4—4 of FIG. 3.
Figure 5:
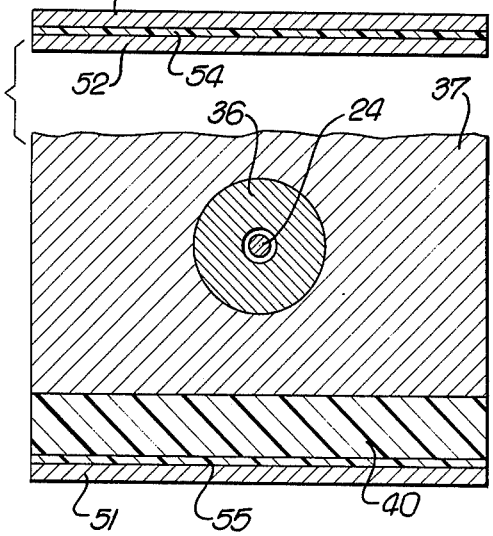
FIG. 5 is a reduced sectional view taken along the line 5—5 of FIG. 3.

In operation, a fluid is moved through the gap, preferably from left to right as shown in FIG. 3, with the transition from the line 20 to the electrode 36 providing an increased flow velocity at the gap between the electrodes. A typical fluid flow system is shown in FIG. 2, with the fluid from line 35 going to one or more cooler/condensers 63 and then to a purification system 64 from which the fluid is pumped into the line 20 by a pump 65 and an appropriate throttling valve 66 to control the flow rate and/or vapor pressure through the spark gap. Of course, there are other fluid flow systems which can be utilized as desired.

Liquid and/or easily condensable vapor dielectrics are preferred for the fluid in the spark gap switch of the present invention. Hydrocarbons, liquified gases and fluorinated and chlorinated compounds are suitable. For pulsed or high frequency voltages, water is also a good liquid dielectric. Carbon tetrachloride, hexane, octane, and standard transformer insulating oils are satisfactory as liquid dielectrics, while low boiling point Freons are satisfactory as vapor dielectrics. The latter have the advantage that they are readily compressible for relief of hydrodynamic pressure at the spark gap during the pulsed discharge, and also readily recondensable into liquid form through suitable cooling so as to minimize the pumping power requirement.

The electrodes 24, 36 preferably are made of a refractory metal of high thermal conductivity, such as molybdenum or an alloy such as Elkonite. In operation with a gap spacing in the order of one millimeter and a flow rate at the gap in the order of several meters per second, kilocycle repetition rates for the switch are obtainable. The high rate of flow sweeps discharge contaminants out of the gap before the switch is recharged.

We claim:

1. In a spark gap switch, the combination of:
a first central electrode;
a second annular electrode;
a first fluid line;
a second fluid line;
a first electrical conducting frame, with said first electrode and fluid line mounted therein for fluid flow through said line about said electrode;
a second electrical conducting frame, with said second electrode and fluid line mounted therein for fluid flow through said line and electrode;
an electrical insulator;
means for mounting said insulator between said first and second frames in fluid sealing relation, with said first electrode positioned within said second electrode, and with said insulator defining a fluid flow path between said lines; and
means for connecting a voltage across said electrodes.

2. A spark gap switch as defined in claim 1 wherein said means for connecting includes first and second coaxial electrical conductors joined to said first and second frames respectively.

3. A spark gap switch as defined in claim 1 wherein said first and second lines are in axial alignment at said frames, with the aperture of said second electrode less than that of said lines.

4. A spark gap switch as defined in claim 3 wherein the flow path of said insulator is tapered providing a transition between the fluid line and the annular electrode aperature.

5. A spark gap switch as defined in claim 1 wherein said first central electrode has a tapered end positioned in said second annular electrode, and including means for moving said first electrode axially relative to said second electrode.

6. A spark gap switch as defined in claim 1 wherein said first central electrode is mounted within said first line and has a tapered end positioned in said second annular electrode, and including means for moving said first electrode and line axially relative to said second electrode.

7. A spark gap switch as defined in claim 6 wherein said means for moving includes interengaging threads on said first line and frame, with said line rotatable relative to said frame to advance said first electrode in said second electrode.

8. A spark gap switch as defined in claim 1 including means for moving a dielectric fluid about said first electrode through said lines and second electrode.

9. A spark gap switch as defined in claim 8 wherein said dielectric fluid is a liquid dielectric.

10. A spark gap switch as defined in claim 1 including means for moving a dielectric fluid in through said first line about said first electrode through said second electrode and out through said second line.

11. A spark gap switch as defined in claim 1 wherein said first line includes a first section of smaller internal cross section area and a second section of larger internal cross section area with a third transition section therebetween, and
means for mounting said first electrode in said second section of said first line and projecting from said first line through said insulator into said second electrode.

12. A spark gap switch as defined in claim 1 wherein said means for connecting includes first and second coaxial electrical conductors joined to said first and second frames respectively, with said second conductor positioned about said second line and with said first conductor positioned concentrically about and spaced from said second conductor.

13. A spark gap switch as defined in claim 1 wherein said means for connecting includes first and second parallel electrical conductors joined to said first and second frames respectively.

14. A spark gap switch as defined in claim 1 including means for inducing a vortical motion in the flow between said electrodes.

15. A spark gap switch as defined in claim 1 including:
means for introducing a dielectric vapor under pressure into one of said fluid lines for flow between said electrodes; and
cooler means connected to the other of said fluid lines for condensing said vapor into a liquid.

16. A spark gap switch as defined in claim 1 including a throttling valve connected in the fluid line upstream of the gap between the electrodes for control of fluid flow through said gap.

* * * * *